US006008145A

United States Patent [19]

Dzen et al.

[11] Patent Number: 6,008,145

[45] Date of Patent: Dec. 28, 1999

[54] COMPOSITION FOR THE PERMANENT HYDROPHILATION OF POLYOLEFIN FIBRES, USE OF THE COMPOSITION AND FIBRES TREATED THEREWITH

[75] Inventors: Zang-Ju Dzen, Aidlingen; Christine Wild, Wernau, both of Germany

[73] Assignee: Schill & Seilacher GmbH & Co., Germany

[21] Appl. No.: 08/963,929

[22] Filed: Nov. 4, 1997

[30] Foreign Application Priority Data

Nov. 4, 1996 [DE] Germany ..... 196 45 280

[51] Int. Cl.[6] ..... B32B 27/18; C09K 3/16; D06M 13/419; D06M 13/507

[52] U.S. Cl. ..... 442/118; 106/287.11; 252/8.63; 252/8.83; 427/378; 442/119; 442/170; 442/171; 516/55; 516/70

[58] Field of Search ..... 252/312, 8.63, 252/8.83; 106/287.11; 442/118, 119; 516/55, 70; 428/378

[56] References Cited

U.S. PATENT DOCUMENTS

| | | | |
|---|---|---|---|
| 3,074,815 | 1/1963 | Lee et al. | 252/8.63 X |
| 3,492,324 | 1/1970 | Blackman | 252/8.63 X |
| 4,906,413 | 3/1990 | Töpfl et al. | 252/8.63 X |
| 4,921,895 | 5/1990 | Schafer et al. | 524/379 |
| 4,988,449 | 1/1991 | Kato et al. | 252/8.8 |
| 5,057,361 | 10/1991 | Sayovitz et al. | 442/118 |
| 5,258,129 | 11/1993 | Kato et al. | 252/8.9 |
| 5,302,657 | 4/1994 | Huhn et al. | 524/588 |
| 5,656,585 | 8/1997 | Grandmaire et al. | 252/312 X |

FOREIGN PATENT DOCUMENTS

| | | | |
|---|---|---|---|
| 0339179 | 11/1989 | European Pat. Off. | D06M 156/47 |
| 0442098 | 8/1991 | European Pat. Off. | C08L 83/04 |
| 0503221 | 9/1992 | European Pat. Off. | C11D 3/00 |
| 0410485 | 3/1996 | European Pat. Off. | D06M 13/224 |
| 3802622 | 8/1989 | Germany | D06M 15/643 |
| 4004946 | 8/1991 | Germany | C08L 83/04 |
| 4402852 | 2/1995 | Germany | D06M 13/463 |
| 4338998 | 5/1995 | Germany | C07C 219/18 |
| 4439076 | 5/1996 | Germany | D06M 13/463 |
| 19539846 | 11/1996 | Germany | C07C 219/04 |

*Primary Examiner*—Richard D. Lovering
*Attorney, Agent, or Firm*—Hayes Soloway Hennessey Grossman & Hage PC

[57] ABSTRACT

A composition for the permanent hydrophilation of polyolefin fibers and filaments and non-woven textile articles (non-wovens) produced therefrom, contains 15 to 75 parts by weight of at least one non-ionic surfactant, and 25 to 85 parts by weight of at least one quaternary ammonium compound and/or at least one cationically modified polydimethyl siloxane. The composition has excellent permanent hydrophilating properties, an excellent cohesion effect and good antistatic properties. When diluted with water, these compositions can therefore be used particularly satisfactorily as spinning preparations for the permanent hydrophilic finishing of polyolefin fibers, polyolefin filaments and non-wovens produced therefrom, in particular fleeces.

21 Claims, No Drawings

COMPOSITION FOR THE PERMANENT HYDROPHILATION OF POLYOLEFIN FIBRES, USE OF THE COMPOSITION AND FIBRES TREATED THEREWITH

FIELD OF THE INVENTION

The invention relates to compositions, preferably in the form of spinning preparations, for polyolefin fibres or filaments which can impart permanent hydrophilic properties to these fundamentally hydrophobic fibres, and to fibres and filaments treated or finished with the said compositions, and to non-woven textile fabrics, in particular fleeces, produced therefrom.

BACKGROUND OF THE INVENTION

Hydrophilic fleeces are used as covering fleeces, i.e. as the topmost fleece or as the intermediate fleece of multiple-layer fleeces, for babies' nappies, incontinence products and similar articles. The purpose of such fleeces is to convey body fluids such as urine rapidly to the absorptive layer situated thereunder. Conventional hydrophilating preparations are washed out from the fleece more or less quickly and more or less intensively by the passage of fluids inside the nappies or other products. As a result, the covering fleece gradually loses its hydrophilic properties and, because of the hydrophobic properties of polyolefins, it becomes increasingly hydrophobic. With subsequent further contact with body fluid, passing the latter on to the absorptive layer becomes increasingly difficult and finally quite impossible. The result is that the fluid from the product runs out without retention or with less retention, and that the product can no longer carry out its original function of keeping the skin of a baby or a patient dry.

In contrast, a preparation for permanent hydrophilation should remain adhering to the polyolefin as permanently as possible and should impart as constant an hydrophily as possible to the fleece over as long a duration as possible.

A fleece is usually formed from filaments and/or fibres, in which case matted fibre fleeces are usually strengthened either by means of physical methods, for example by needling, or in a chemical manner. During the production of carded fleeces which have to be subsequently thermofixed, an hydrophilating spinning preparation must additionally meet further requirements: The preparation has to allow the fibres to be produced and treated; this involves optimum sliding properties and cohesion of the fibres or filaments and an adequate antistatic finishing to allow the fleece formation to be performed at an acceptable rate.

Hydrophilating compositions, which contain diethanolamides, non-ionic surfactants, alkyl phosphates, quaternary ammonium salts and/or alkyl imidazolium salts and which are used as fluid-permeability-promoting agents for polyolefin non-wovens, are known from the U.S. Pat. No. 4,988,449.

Hydrophilating compositions, which contain polyoxyalkylene-modified polydimethyl siloxane alone or together with non-ionic surfactants, alkyl phosphates, quaternary ammonium salts and/or alkyl imidazolium salts, are known from the U.S. Pat. No. 5,258,129.

A process for hydrophilating polyolefin-fibre fleeces by applying an aqueous alkoxylated surfactant composition to the surface of the fibres is known from EP-B 1-0 410 485, in which the composition either consists up to at least 80% of alkoxylated triglycerides of $C_{18}$ fatty acids, in which case the said triglycerides have a large proportion of alkoxylated ricinolein or of alkoxylated and hydrogenated ricinolein, or consists up to at least 80% of a mixture of alkoxylated or alkoxylated and hydrogenated ricinolein, a polyalkylene-modified water-soluble polydimethyl siloxane and an antistatic compound, in which case the said compound can be for example a neutralized phosphoric acid ester, an alkoxylated phosphate, a potassium salt, an ammonium salt or an alkoxylated ammonium salt.

Although these known compositions impart permanent hydrophilic properties to the fibres and fibre fleeces treated or finished therewith, they are expensive to produce and are in need of improvement with respect to the cohesion achievable and the antistatic properties.

SUMMARY OF THE INVENTION

The object of the invention is therefore to provide a composition with satisfactory permanent hydrophilating properties and with an improved cohesion effect and satisfactory anti-static properties, in order to permit high fleece-production rates and and high rates generally in the processing of the treated or finished fibres, filaments and the non-wovens produced therefrom.

This object is attained according to the invention by a composition for the permanent hydrophilation of polyolefin fibres and filaments and non-woven textile articles (non-wovens) produced therefrom, containing A) 15 to 75 parts by weight of at least one non-ionic surfactant, and B) 25 to 85 parts by weight of a component consisting of at least one quaternary ammonium compound of the general formula I (I)

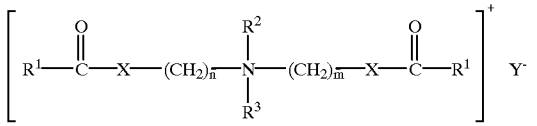

in which $R^1$ is an alkyl group with from 1 to 18 carbon atoms or an alkenyl group with from 2 to 18 carbon atoms, $R^2$ and $R^3$, independently of each other, are an alkyl group with from 1 to 18 carbon atoms, hydroxyethyl or a polyglycol residue, X is an oxygen atom, NH, N—$CH_3$ or an $(OC_2H_4)_z$ group with z=1 to 10, $Y^-$ is one of the anions $CH_3OSO_3$—, $C_2H_5OSO_3$—, $CH_3COO^-$, $Cl^-$, phosphate, lactate, m and n, independently of each other, are an integer from 1 to 6 and/or at least one cationically modified polydimethyl siloxane of the formula IIa or IIb (IIa)

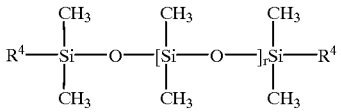

(IIb)

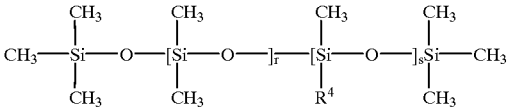

in which r and s, independently of each other, are an integer from 1 to 50

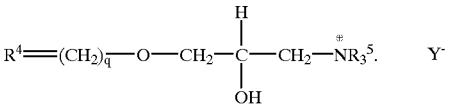

$Y^-$ is one of the anions $CH_3OSO_3^-$, $C_2H_5OSO_3^-$, $CH_3COO^-$, $Cl^-$, phosphate, lactate or

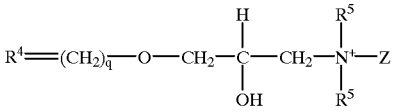

with $Z=CH_2COO^-$ or $CH_2—CH_2—CH_2—NH—CO—R^6.Y^-$ $R^6$=a saturated or unsaturated alkyl residue with from 4 to 22 carbon atoms or a mixture of such alkyl residues $R^5=CH_3$ or $C_2H_4OH$ q=an integer from 3 to 18.

The composition according to the invention has excellent permanent hydrophilating properties, an excellent cohesion effect and good antistatic properties. When diluted with water, these compositions can therefore be used particularly satisfactorily as spinning preparations for the permanent hydrophilic finishing of polyolefin fibres, polyolefin filaments and non-wovens produced therefrom, in particular fleeces.

DETAILED DESCRIPTION OF PREFERRED EMBODIMENTS

In those embodiments of the invention in which the component B contains at least one cationically modified polydimethyl siloxane of the formula (IIa) or (IIb), the use of those polydimethyl siloxanes is preferred in which the residue $R^4$ is present as a free or "true" cation. In contrast, those polydimethyl siloxanes, in which the residue $R^4$ has an amphoteric betaine structure, are somewhat poorer, but still perfectly acceptable with respect to the permanent hydrophilating properties, and are less expensive and thus more economical than the more effective but more expensive "truly" cationically modified silicones.

The non-ionic surfactant, component A of the composition according to the invention, is preferably selected from the following group of compounds, which as a whole contain in their molecule one or more alkoxylated $C_8$ to $C_{18}$ hydrocarbon chains which can be branched or straight-chained, and saturated or unsaturated, in each case: alkoxylated $C_8$ to $C_{18}$ fatty alcohols, alkoxylated $C_8$ to $C_{18}$ amines, alkoxylated $C_8$ to $C_{18}$ amides, alkoxylated $C_8$ to $C_{18}$ fatty acids, alkoxylated $C_8$ to $C_{18}$ fatty acid esters and alkoxylated $C_8$ to $C_{18}$ alkyl phenols.

In addition, those compositions according to the invention are preferred which contain the components A (non-ionic surfactant) and B (quarternary ammonium compound and/or cationically modified polydimethyl siloxane) in a ratio by weight of approximately 1:1.

Those polydimethyl siloxanes of formula Ia, in which the terminal group Z in the residue $R^4$ is a cocoamido propyl residue and $Y^-$ is one of the above-mentioned anions, are preferably used as component B or as a constituent of component B.

The composition according to the invention is preferably present in the form of an aqueous dispersion or emulsion, of which the content of active components amounts to from 0.5 to 20% by weight. The term "active components" is understood to cover the components A and B and the further constituents optionally added as component C, with the exception of water.

The compositions according to the invention are preferably optionally set by dilution with water in such a way that their kinematic viscosity at 20° C. is in the range of between 1 and 200 $mm^2/s$ (centistokes), and preferably in particular between 1 and 10 $mm^2/s$.

In addition, the composition according to the invention can contain at least one cohesion agent, lubricant, corrosion-protection agent and/or at least one emulsifier as component C.

A ricinol ethoxylate is preferably used as a cohesion agent.

The lubricant is preferably a fatty acid ethoxylate.

A fatty acid amine derivative is preferably used as a corrosion-protection agent for protecting the metallic parts of the spinning machines and the other treatment machines, for example the carding machines.

The emulsifier is preferably likewise a fatty acid ethoxylate.

The composition according to the invention is preferably used as a permanent hydrophilating spinning preparation for polyolefin fibres or filaments and, on the other hand, as an agent for the permanent hydrophilic finishing of non-woven textile fabrics (non-wovens), in particular polyolefin-fibre fleeces, produced from polyolefin fibres or filaments.

The composition used in each case is applied in the form of an aqueous emulsion or in the form of an aqueous dispersion to the fibres, filaments or non-wovens, namely in a quantity of from 0.2 to 2%, relative to the dry weight of the respective product (fibre, filament, fleece).

The application of the composition is carried out, as known to the person skilled in the art, by way of metering rods, kiss rolls, immersion baths or by spraying.

The subject of the invention is therefore polyolefin fibres and filaments which are finished or treated in a permanent hydrophilic manner with one of the compositions according to the invention, and also, on the other hand, non-woven textile fabrics (non-wovens), in particular fleeces, of polyolefin fibres or filaments which have been finished or treated in a permanent hydrophilic manner with a composition according to the invention, in which case a double finishing or treatment is also possible, i.e. the fibres or filaments are first finished in a permanent hydrophilic manner and the fleece produced therefrom is then finished as a whole in a permanent hydrophilic manner once again with a composition according to the invention.

It is particularly preferred if the fibre fleeces finished according to the invention are non-compressed matted fibre fleeces or chemically or physically strengthened, for example needled or thermofixed fibre fleeces.

The invention is explained in greater detail below with reference to preferred embodiments:

EXAMPLE 1

Component A:

31.5% by weight of fatty acid polyethylene glycol ester methyl ether (non-ionic surfactant)

Component B:

48.5% by weight of di(palm-carboxyethyl) hydroxyethyl methyl ammonium methosulphate (quaternary ammonium compound)

Component C:

10% by weight of ethoxylated ricinol (cohesion agent) and 10% by weight of fatty acid polyethylene glycol ester (emulsifier and lubricant).

The components A, B and C are thoroughly mixed together and homogenized. The composition thus obtained is then diluted with distilled or de-mineralized water so as to form a 10% by weight aqueous dispersion of the composition. This 10% dispersion is used as a spinning preparation for the permanent hydrophilic finishing of three polypropylene substrates, namely PP fibres with a titre of 2.2 dtex, a PP spun-bond fleece with a weight per unit area of 23 g/m$^2$ and PP filaments 450/34.

The testing of this composition in conjunction with the said textile substrates is described in greater detail below with reference to the Table.

EXAMPLE 2

Component A:

26% by weight of fatty acid polyethylene glycol ester methyl ether (non-ionic surfactant)

Component B:

57% by weight of di(palm-carboxyethyl) hydroxyethyl methyl ammonium methosulphate (quaternary ammonium compound)

Component C:

8.5% by weight of ethoxylated ricinol (cohesion agent) and 8.5% by weight of fatty acid polyethylene glycol ester (emulsifier and lubricant).

The components A, B and C are intensively mixed together and homogenized and the composition is diluted with water and dispersed therein, as described in Example 1. The 10% aqueous dispersion is used as a spinning preparation and is tested with the same textile substrates, which are also used for testing the composition according to Example 1.

EXAMPLE 3

Component A:

24% by weight of fatty acid polyethylene glycol ester methyl ether (non-ionic surfactant)

Component B:

47% of di(palm-carboxyethyl) hydroxyethyl methyl ammonium methosulphate (quaternary ammonium compound) and 13% by weight of Tegopren® 6920 (cationically modified polydimethyl siloxane, producer: Th. Goldschmidt AG, Essen)

Component C:

8% by weight of ethoxylated ricinol (cohesion agent) and 8% by weight of fatty acid polyethylene glycol ester (emulsifier and lubricant).

The components A, B and C are intensively mixed together and homogenized and, as described in Example 1, are diluted with water and dispersed therein. The 10% aqueous dispersion thus obtained is used as a spinning preparation, and the permanent hydrophilating effect is tested with PP fibres with a titre of 2.2 dtex and with a fleece of PP fibres with a titre of 1.7 dtex and with a weightper unit area of 23 g/m$^2$.

EXAMPLE 4

Component A:

25% by weight of fatty acid polyethylene glycol ester methyl ether (non-ionic surfactant)

Component B:

50% by weight of di(palm-carboxyethyl) hydroxyethyl methyl ammonium methosulphate (quaternary ammonium compound) and 25% by weight of Tegopren® 6920 (cationically modified polydimethyl siloxane).

The components A and B are carefully mixed together and homogenized and dispersed in water, as described in Example 1. The 10% dispersion produced is used as a spinning preparation, and is tested with two different PP fleeces, each with a weight per unit area of 23 g/m$^2$, in which case a fleece was produced from filaments with a titre of 1.7 dtex, whilst the titre in the second case amounted to 2.2 dtex.

Comparative Example

For comparison purposes an hydrophilating standard spinning preparation of Schill & Seilacher GmbH & Co., Boblingen, was used which is available commercially under the name Silastol® GF 602. This is a mixture of fatty acid ethoxylates, ricinol ethoxylates and phosphoric-acid esters. Testing the polypropylene fibres, filaments and fleeces finished with the compositions according to Examples 1 to 4 and according to the Comparative Example The following Table sets out the results of 11 tests, which have been carried out with the spinning preparations according to the invention and with the known preparation according to the Comparative Example in the case of three different textile substrates. Tests 1 to 3 have been carried out with the composition according to Example 1, Tests 4 to 6 with the composition according to Example 2, Tests 7 and 8 with the composition according to Example 3, Tests 9 and 10 with the composition according to Example 4, and Test 11 with the composition according to the Comparative Example. The individual components of the compositions are indicated in % by weight in the Table.

The charge weight of active substance in the preparation amounted in all cases to 0.5%, relative to the dry weight of the respective textile substrate. All the textile substrates indicated in the Table were of polypropylene. The titres of the fibres and filaments are indicated in the Table, and likewise the weight per unit area of the fleeces.

The sinking time, the Mahlo value, the strike-through time, the re-wetting, the thread/thread friction (T/T), the thread/solid friction (T/S) and the cohesion (stick slip) were determined.

Sinking time

The sinking time was measured in accordance with the ASTM method D-1117-79. In this case, 5 g of a fibre or filament sample are weighed into a wire cage approximately 3 g in weight. The cage is thrown from a height of 5 cm into a beaker filled with distilled water. The time after which the basket is completely immersed in the water is measured. The shorter the sinking time, the more rapidly the fibre or the filament absorbs water.

Mahlo test

The surface conductivity of the prepared fibres or filaments is measured with an hygrometer, the textometer Type DMB-6 of the firm Mahlo GmbH, Saal/Donau. The value is indicated in scale divisions (scd). These do not represent absolute values, but only relative values as compared with a standard. The higher the value, the better the antistatic finishing of the fibre.

Strike-through time

The time required for 5 ml of a synthetic urine solution to penetrate a prepared fleece and to reach the absorptive layer of filter paper situated thereunder is measured in accordance with the EDANA method ERT 150.2-93. In order to test whether the hydrophilating finishing is washed out or is in fact permanently hydrophilating, the measurement is carried out five times in succession on the same fleece, the absorptive filter paper being renewed in each case. The five measurement values are indicated in seconds.

Re-wetting

The quantity (in grammes) of fluid which flows back into a superposed dry filter paper when a thoroughly wetted fleece is loaded by a 4 kg weight is measured in accordance with the EDANA method ERT 151.0-93.

Friction values

The friction values are measured in accordance with the firm's internal test standards. In order to determine the thread/thread friction, the thread to be tested is deflected by means of a roller through approximately 180°. The two strands moving in opposite directions are intertwined by rotation, namely three times through 360°, so that an approximately longitudinal friction of the thread portions against each other occurs. The thread tension is measured in newtons.

The thread/solid friction is measured on a thread which runs at a constant speed around a stationary friction body of ceramics or metal. The thread tension is measured before and after the friction point. The difference is indicated in newtons in the Table.

Cohesion (stick slip)

In this case the thread/thread adhesion of a filament is measured at room temperature, the thread being measured at a draw-off speed of 0.6 mm/min. The duration of measurement amounts to 30 min. The fluctuation in tension is measured in newtons. Average values from 8 or 9 individual filaments are indicated in the Table.

As shown in the Table, the presence of a cationically modified polydimethyl siloxane in component B has a positive effect upon the water-absorption rate (sinking time) and upon the antistatic properties (Mahlo).

In this way, the compositions according to the invention provide the person skilled in the art with a further agent which is eminently suitable for the permanent hydrophilating finishing of polyolefin fibres and filaments as well as textile fabrics produced therefrom and which can be used to particular advantage for producing hydrophilic covering fleeces for babies' nappies and incontinence products. In addition, the compositions according to the invention result in a perceptibly improved cohesion of the non-wovens finished therewith and in improved antistatic properties; this in turn has the result that the textile article can be produced and treated at higher rates than hitherto.

TABLE

| | | Spinning preparation [%] | | | | | |
|---|---|---|---|---|---|---|---|
| | | A | B | | | | |
| Test No. | Ex. No. | Non-ionic surfac. [%] | quat. ammonium comp. | Cation. silicone | C Additive | Charge % | Substrate |
| 1 | 1 | 31.5 | 48.5 | — | 20 | 0.5 | 2.2 dtex, fibre |
| 2 | 1 | 31.5 | 48.5 | — | 20 | 0.5 | Spunbond 23 g/m2 |
| 3 | 1 | 31.5 | 48.5 | — | 20 | 0.5 | PP-Filament 450 F34 |
| 4 | 2 | 26 | 57 | — | 17 | 0.5 | Spunbond 23 g/m2 |
| 5 | 2 | 26 | 57 | — | 17 | 0.5 | PP-Filament 450/34 |
| 6 | 2 | 26 | 57 | — | 17 | 0.5 | 2.2 dtex fibre |
| 7 | 3 | 24 | 47 | 13 | 16 | 0.5 | 1.7 dtex 23 g/m2 |
| 8 | 3 | 24 | 47 | 13 | 16 | 0.5 | 2.2 dtex fibre |
| 9 | 4 | 25 | 50 | 25 | — | 0.5 | Spunbond 23 g/m2 |
| 10 | 4 | 25 | 50 | 25 | — | 0.5 | 2.2 dtex 23 g/m2 |
| 11 | C.E. | | Standard (hydrophilic) | | | 0.5 | 2.2 dtex 23 g/m2 |

| Test No. | Sinking time [sec.] | Mahlo [scd] | Strike through (5-fold) [sec.] | rewet [g] | T/T [N] | T/S [N] | stick-slip [N]/ counts 30 min. |
|---|---|---|---|---|---|---|---|
| 1 | 7.8 | 60 | — | — | — | — | — |
| 2 | — | — | 3.0/4.5/6.2/7.1/8.1 | 0.08 | — | — | — |
| 3 | — | — | — | — | 0.57 | 0.51 | 42–48/9 |
| 4 | — | — | 2.8/3.7/5.4/6.6/10.7 | 0.1 | — | — | — |
| 5 | — | — | — | — | 0.58 | 0.54 | 41–50/8 |
| 6 | 7.2 | 60 | — | — | — | — | — |
| 7 | — | — | 2.6/3.1/5.0/6.5/7.8 | 0.15 | — | — | — |
| 8 | 5.1 | 65 | — | | — | — | — |
| 9 | — | — | 2.7/2.9/3.2/4.0/5.5 | 0.2 | — | — | — |
| 10 | — | — | — | — | — | — | — |
| 11 | 3.8 | 35 | 2.7/8.9/16.7/— | 0.15 | 0.56 | 0.50 | 42–50/9 |

% = % by weight
C.E. = comparative Example

It is evident from the Strike-through Test results that even after being wetted five times the compositions according to the invention still convey the charged fluid within 5.5 to 10.7 sec. to the absorptive layer situated thereunder, whereas even at the third wetting the standard preparation of the Comparative Example is only capable of drawing away 5 ml of the charged urine solution extremely slowly (within 16.7 sec.), and after that no longer at all. This demonstrates that although the standard preparation has excellent hydrophilating effects for a single use, it has no permanent hydrophilating effects, since after multiple wettings the preparation has evidently been washed off from the fibre or filament.

With respect to re-wetting, those embodiments of the composition according to the invention are clearly better than the comparative preparation which do not contain any portion of cationically modified silicone.

With respect to the friction values measured, the fibres finished with the compositions according to the invention do not differ from those finished with the standard preparation.

We claim:

1. A composition for the permanent hydrophilation of polyolefin fibres and filaments and non-woven textile articles (non-wovens) produced therefrom, comprising A) 15 to 75 parts by weight of at least one non-ionic surfactant, and B) 25 to 85 parts by weight of a component consisting of at least one quaternary ammonium compound of the general formula I

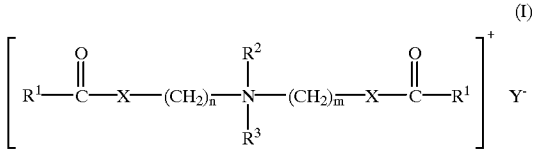

(I)

in which $R^1$ is an alkyl group with from 1 to 18 carbon atoms or an alkenyl group with from 2 to 18 carbon atoms, $R^2$ and $R^3$, independently of each other, are an alkyl group with from 1 to 18 carbon atoms, hydroxyethyl or a polyglycol residue, X is an oxygen atom, NH, N—$CH_3$ or an $(OC_2H_4)_z$ group with z=1 to 10, $Y^-$ is one of the anions $CH_3OSO_3^-$, $C_2H_5OSO_3^-$, $CH_3COO^-$, $Cl^-$, phosphate, lactate, m and n, independently of each other, are an integer from 1 to 6 and at least one cationically modified polydimethyl siloxane of the formula IIa or IIb (IIa)

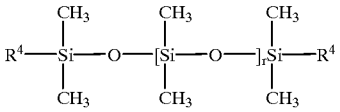

(IIb)

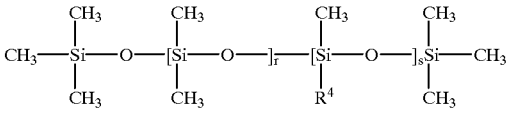

in which r and s, independently of each other, are an integer from 1 to 50

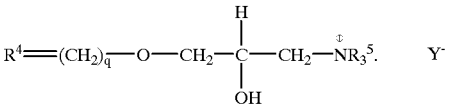

$Y^-$ is one of the anions $CH_3OSO_3^-$, $C_2H_5OSO_3^-$, $CH_3COO^-$, $Cl^-$, phosphate, lactate or

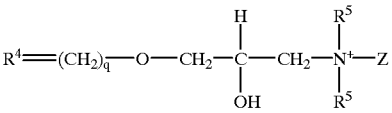

with Z=$CH_2COO^-$ or $CH_2$—$CH_2$—$CH_2$—NH—CO—$R^6.Y^{31}$ $R^6$=a saturated or unsaturated alkyl residue with from 4 to 22 carbon atoms or a mixture of such alkyl residues $R^5$=$CH_3$ or $C_2H_4OH$ q=an integer from 3 to 18.

2. The composition of claim 1, wherein the kinematic viscosity of said composition at 20° C. amounts to from 1 to 200 $mm^2/s$.

3. The composition of claim 1, wherein the kinematic viscosity of said composition at 20° C. amounts to from 1 to 10 $mm^2/s$.

4. The composition of claim 1, wherein the non-ionic surfactant (component A) is selected from the group consisting of alkoxylated $C_8$ to $C_{18}$ fatty alcohols, alkoxylated $C_8$ to $C_{18}$ amines, alkoxylated $C_8$ to $C_{18}$ amides, alkoxylated $C_8$ to $C_{18}$ fatty acids, alkoxylated $C_8$ to $C_{18}$ fatty acid esters and alkoxylated $C_8$ to $C_{18}$ alkyl phenols, wherein the $C_8$ to $C_{18}$ hydrocarbon chain can be branched or straight-chained, and saturated or unsaturated, in each case.

5. The composition of claim 1, wherein the components A (non-ionic surfactant) and B (quaternary ammonium compound and cationically modified polydimethyl siloxane) are contained in a ratio by weight of approximately 1:1.

6. The composition of claim 1, wherein said composition is present in the form of an aqueous dispersion or emulsion, of which the content of active components amounts to from 0.5 to 20% by weight.

7. The composition of claim 1, additionally containing as component C at least one of a cohesion agent, a lubricant, a corrosion-protection agent, and at least one emulsifier.

8. The composition of claim 7, wherein said cohesion agent is a ricinol ethoxylate.

9. The composition of claim 7, wherein said lubricant is a fatty acid ethoxylate.

10. The composition of claim 7, wherein said corrosion-protection agent is a fatty acid amine derivative.

11. The composition of claim 7, wherein said at least one emulsifier is a fatty acid ethoxylate.

12. A method for the permanent hydrophilation of polyolefin fibres or filaments comprising contacting said polyolefin fibres or filaments with the composition of claim 1 as a permanent hydrophilating spinning preparation.

13. A method for the permanent hydrophilic finishing of non-woven textile fabrics (non-wovens) comprising contacting said non-wovens with the composition of claim 1.

14. The method of claim 13 wherein polyolefin-fibre fleeces produced from polyolefin fibres or filaments are contacted as said non-wovens.

15. A method for the permanent hydrophilation of polyolefin fibres or filaments comprising contacting said polyolefin fibres or filaments with the composition of claim 7 as a permanent hydrophilating spinning preparation.

16. A method for the permanent hydrophilic finishing of non-woven textile fabrics (non-wovens) comprising contacting said non-wovens with the composition of claim 7.

17. The method of claim 16 wherein polyolefin-fibre fleeces produced from polyolefin fibres or filaments are contacted as said non-wovens.

18. A polyolefin fibre or filament, finished or treated in a permanent hydrophilic manner with the composition of claim 1.

19. A non-woven textile fabric (non-woven) of polyolefin fibres or filaments, which is finished in a permanent hydrophilic manner with the composition of claim 1.

20. The fabric of claim 19, wherein said fabric is a polyolefin matted-fibre fleece.

21. The fabric of claim 19, wherein said fabric is a needled polyolefin-fibre fleece.

* * * * *

UNITED STATES PATENT AND TRADEMARK OFFICE

CERTIFICATE OF CORRECTION

PATENT NO. : 6,008,145
DATED : December 28, 1999
INVENTOR(S) : Zang-Ju Dzen and Christine Wild It is certified that error appears in the above-identified patent and that said Letters Patent is hereby corrected as shown below:

Column 9, claim 1,
Line 48, change "$R^6$. $Y^{31}$" to -- $R^6$. $Y^-$ --.

Signed and Sealed this

Twenty-ninth Day of January, 2002

*Attest:*

*Attesting Officer*

JAMES E. ROGAN
*Director of the United States Patent and Trademark Office*